United States Patent [19]

Mikhailov et al.

[11] 4,249,871

[45] Feb. 10, 1981

[54] PLANT FOR PRODUCING REINFORCED-CONCRETE PIPES

[76] Inventors: Viktor V. Mikhailov, ulitsa Chkalova, 25, kv. 14; Alexandr K. Karakovsky, Novozykovsky proezd, 3, kv. 23; Petr Y. Dyachenko, Shosseinaya ulitsa, 40, kv. 126; Jury S. Ivanov, Zelenodolskaya ulitsa, 24, kv. 108; Igor V. Mikhailov, Zhivopisnaya ulitsa, 4, korpus 4, kv. 55; Mikhail G. Lunin, ulitsa Okskaya 22/2, kv. 9; Alexei V. Buyanov, Nizhegorodskaya ulitsa, 7a, kv. 50; Alexei A. Konstantinov, ulitsa Khlobystova, 20, korpus 2, kv. 30, all of Moscow; Anatoly S. Shagurin, ulitsa Uritskogo, 23, kv. 67, Ljubertsy Moskovskoi oblasti; Alexandr P. Kirillov, 2 Setunsky pereulok, 11, kv. 69, Moscow; Oleg V. Mikhailov, Chertanovo, ulitsa Krasny Mayak, 8, korpus 2, kv. 361, Moscow; Arkady S. Khaimov, 4 Veshnyakovsky proezd, 7, kv. 48, Moscow, all of U.S.S.R.

[21] Appl. No.: 70,144

[22] Filed: Aug. 27, 1979

[30] Foreign Application Priority Data

Oct. 3, 1978 [SU] U.S.S.R. ..... 2665134

[51] Int. Cl.[3] ..... B28B 23/14

[52] U.S. Cl. ..... 425/111; 264/228; 264/308; 425/88; 425/218

[58] Field of Search ..... 425/88, 111, 218, 219, 425/264, 425; 264/228, 308; 249/64, 144, 176

[56] References Cited

U.S. PATENT DOCUMENTS

| | | | |
|---|---|---|---|
| 1,597,220 | 8/1926 | Tuerck | 425/425 X |
| 2,966,715 | 1/1961 | Vianni | 425/111 |
| 3,281,910 | 11/1966 | Robinson | 425/262 |

*Primary Examiner*—Thomas P. Pavelko

*Attorney, Agent, or Firm*—Robert E. Burns; Emmanuel J. Lobato; Bruce L. Adams

[57] ABSTRACT

A characteristic feature of the present invention is the fact that the pipe producing plant has a horizontal platform rotatable round a vertical axis, on which a mould with conduit formers for pipe making is located. The base of the plant mounts a mechanism for feeding, tensioning of the reinforcement wire and wounding it onto a moulded pipe, and bench carrying a mechanism for filling the mould with concrete mix, a mechanism for smoothing the pipe end face and a mechanism for placing a protective cement mortar cover upon the reinforcing wire wound onto the moulded pipe. The plant incorporates also a mechanical actuator for alternatively raising and lowering the conduit formers, said actuator being mounted on a rigid base outside the rotary platform.

3 Claims, 15 Drawing Figures

PLANT FOR PRODUCING REINFORCED-CONCRETE PIPES

BACKGROUND OF THE INVENTION

This invention relates to devices for producing reinforced-concrete pipes, mostly large-diameter ones (4 to 8 m) made use of in constructing sectional pipelines of diverse applications.

Pipe producing plants made according to the present invention can find application as the component of a casting yard on the object being erected immediately at the sites of constructing sectional pipelines of water-accumulating hydroelectric power stations, as well as land reclamation, water-management and some other structures, the amount of which is growing incessantly.

It is common and widespread practice to use the centrifuging method of making reinforced-concrete pipes, wherein concrete mix filled by the feeder into the interior of a rotating mould, is placed uniformly along the inner perimeter of the cylinder-shaped mould due to a centrifugal force thus developed, then gets compacted to assume a preset shape of pipe. However, the centrifuging method of pipe production is actually practicable for pipes not in excess of 1 m in diameter.

Practical experience in producing reinforced-concrete pipes having 4 to 8 m in diameter is now far from being extensive. Thus, one prior-art plant for producing 8 m diameter pipes is known to comprise the following self-contained devices: a stationary form (or mould) with a concrete mix placer device, a station at which reinforcement (rod or wire) is wound onto the moulded pipe, and a station at which a protective coating is applied to the pipe surface.

A disadvantage of the above-mentioned solution (which is an advanced one as a whole) resides in that the production flow-sheet includes such operations as removal of a semi-finished pipe from one of the devices of the production line, its transferring to other devices and accurate setting of said pipe thereon, which adds to the labour consumption of the pipe production process and involves the use of a complicated specialized equipment and highly skilled personnel to attend said equipment.

Furthermore, descending of a heavy-weight workpiece onto a technological production element results in dynamic loads which accelerate wear of the production equipment and impose some additional requirements thereupon. Moreover, the process of filling the mould (having a perimeter of about 25 m) with concrete mix is a very complicated one, while especially sophisticated is the smoothing of the pipe end face to attain a degree of flatness required for a reliable butt-joining of the pipes.

SUMMARY OF THE INVENTION

It is a primary and essential object of the present invention to provide a plant for producing reinforced-concrete pipes capable of performing a complete pipe production cycle, including its moulding, smoothing its end face, winding a reinforcing wire onto the pipe with a preset tensioning force, and placing a protective coating upon the pipe surface.

It is another object of the present invention to provide a pipe production plant that would enable one to simplify the pipe production process and dispense with a complicated operation of transferring a heavy pipe from one device to another.

It is still another object of the present invention to provide a plant of the character set forth hereinbefore which would make it possible to reduce the amount of production equipment and means required for transferring the pipes from one device to another.

It is still another object of the present invention to provide a plant of the character set forth hereinbefore which would be free from dynamic loads developed by heavy pipes descending thereupon, and would therefore have higher operational reliability and lower mass.

It is yet another object of the present invention to improve the quality of the pipes produced due to attaining a strictly flat pipe end face falling within the tolerance margins required for butt-joining of the pipes.

The above and other objects are accomplished in a plant for producing reinforced-concrete pipes, predominantly large-diameter ones, incorporating conduits for passing ropes adapted to join the pipes when assembling a pipeline. The plant comprises a mould with conduit forming inserts for pipe making the mould is mounted on a base, and a device for filling the mould with concrete mix is provided as well as a station at which the reinforcing wire is wound onto the pipe, and another station at which a protective coating is applied to the pipe surface. According the invention provision is therein made for a horizontal platform rotatable around a vertical axis. The platform carries the mould with the conduit forming inserts for pipe making. The base mounts a bench adapted for filling the mould with concrete mix, smoothing the pipe end face and applying a protective coating to the reinforcing wire wound onto the moulded pipe, the wire being wound with the platform rotating, by being reeled off a mechanism for wire feeding and tensioning which is fixed in place on the base.

It is expedient that the conduit forming inserts have a power actuator for their being alternately raised and lowered and that said power actuator be situated outside the platform on a rigid base.

The essence of the present invention consists in the following.

A pipe mould located on a horizontal platform rotatable around a vertical axis, said mould being composed of a core and an external side-forming shuttering.

Situated immediately close to the platform is a bench which may be made as a metal structure carrying a device for receiving concrete mix and filling it into the mould, a device for smoothing the pipe end face, and a device for placing a protective coating upon the pipe surface, i.e, upon reinforcing wire wound onto the moulded pipe.

Stationary fixing of the devices in combination with rotatable mould renders the proposed plant technologically advantageous over a known pipe production plant, wherein the mould is fixed in position.

It is due to the above feature that the operation of filling the mould with concrete mix is simplified, the perimeter of such mould amounting to 25 m with the pipe diameter of 8 m.

Smoothing of the pipe end face during the pipe rotation with the help of a stationary fixed device makes it possible to meet stricter tolerances for the flatness of the pipe end face which is of great importance for attaining water-proofness or watertightness of pipe joints.

When producing pipes provided with longitudinal conduits in the walls thereof for passing the ropes, a plurality of conduit forming inserts are made fast on the platform, said inserts being raised and lowered by a power actuator fixed stationary outside the platform.

Situated likewise outside the rotary platform on a stationary fixed base is a mechanism for feeding and tensioning the reinforcing wire, whereby the latter is wound onto the moulded pipe during its rotation.

Thus, the entire pipe production cycle occurs at the same place, viz., the horizontal platform rotating at a speed specified for each of the operations or turning cyclically through a required angle.

With such a constructional arrangement the plant is free from the effect of dynamic loads resulting from the weight of the pipe being produced, as distinct from a known pipe production plant, wherein a premoulded (semifinished) pipe is transferred from one device to another and positioned thereon with the use of a complicated handling equipment.

BRIEF DESCRIPTION OF THE DRAWINGS

The aforesaid and other objects and advantages of the present invention will become apparent from a consideration of the following disclosure of a specific embodiment of the plant proposed herein to be read with reference to the accompanying drawings, wherein.

DESCRIPTION OF A PREFERRED EMBODIMENT

Figure 1:
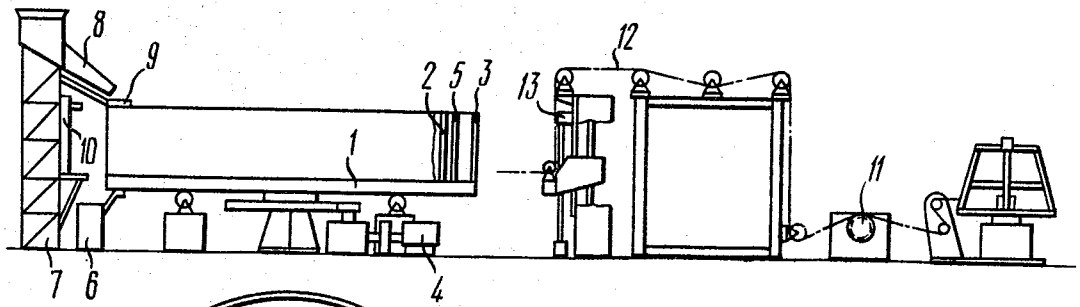
FIG. 1 is a general side-elevation view of the plant, according to the invention.
Figure 2:
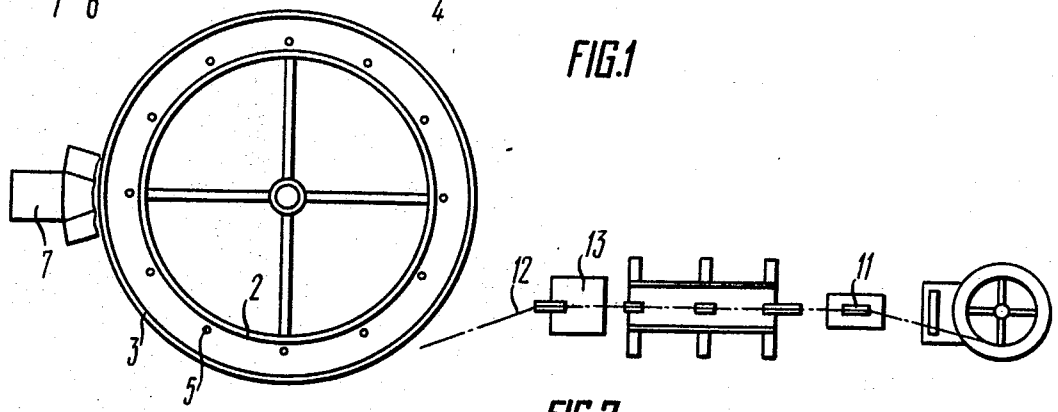
FIG. 2 is a general plan view of the plant, according to the invention.

The plant for producing reinforced-concrete pipes (FIGS. 1, 2) incorporates a horizontal platform 1 rotatable around a vertical axis and carrying a metal mould for pipe forming, composed of a core 2 and an external side-forming shuttering 3, whereas the horizontal surface of the platform 1 serves as the bottom of the mould. The platform 1 rotatable from a power actuator 4 carries a number of conduit-forming inserts 5 which are essentially solid or hollow cylinders made of steel or some other material and having a diameter equal to the diameter of the conduits to be provided in the wall of the pipe being produced. The conduit-forming inserts 5 are set in guide bushings and are free to rise or lower from a power actuator 6 located outside the platform 1 on a rigid base (not shown).

Situated in a close proximity to the platform 1 is a bench 7 made as a metal structure fixed on a stationary base; the bench 7 in turn mounts a device 8 for filling the mould with concrete mix, a device 9 for smoothing the pipe end face, and a device 10 for placing a protective coating to the pipe surface.

The device 8 consists of a feed hopper with an orifice for a proportioned feeding of concrete mix, and an inclined trough for concrete mix to convey and feed to the mould, i.e., to the space confined between the core 2 and the external side-forming shuttering 3. The trough is variable in length so as to suit the wall thickness of the pipe being moulded, that is, the distance between the core and the external side-forming shuttering.

The device 9 incorporates a smoothing member secured in place on a stationary fixed bracket. The smoothing member is not in fact the subject of the present invention, and may be made as a closed cylindrical-surface element having a circular or any other curvilinear cross-section. The generator of the cylinder is square with the surface being smoothed, and the cylinder itself has a metal or elastic (i.e., rubber) bottom which is in effect a smoothing surface.

The device 10 for placing a protective coating has a working member which is not the subject of the present invention, and may be shaped as a nozzle made fast on a bracket and arranged square with the pipe side surface. The nozzle, wherefrom the protective coating is force-fed is vertically traversable in step with rotation of the pipe on the platform.

Located outside the platform on a stationary fixed base is a mechanism 11 for feeding and tensioning of a reinforcing wire 12 which is wound onto the moulded pipe when the platform 1 is rotating. The spacing of the reinforcing wire wound onto the pipe is adjusted by means of a device 13 for laying the reinforcing wire over the pipe length. The speed of vertical traversing of the working member of the device 13 is synchro-tied with rotation of the platform 1.

The plant for producing reinforced-concrete pipes described hereinabove operates as follows.

Reinforcement frameworks 14 of the pipe to be moulded are placed on the platform 1 (FIG. 3), whereon the core 2 of the mould is secured, the platform 1 remaining stationary.

Then the power actuator 6 (FIG. 4) raises the conduit-forming inserts 5 to a position corresponding to the required position of conduits in the pipe to be moulded, while the platform 1 is consecutively turned through a preset angle corresponding to the spacing between the conduits as along as the pipe perimeter.

Figures 3, 4, 5, 6, 7, 8, 9:
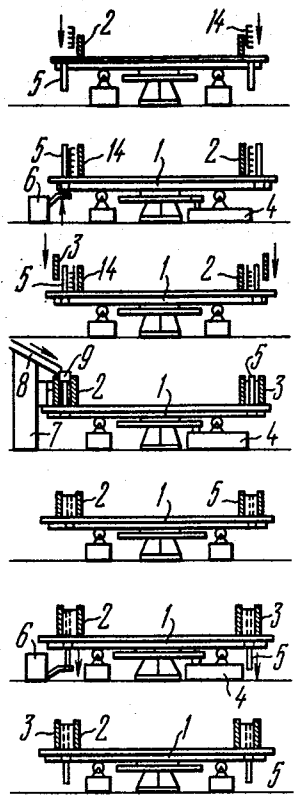

In the position shown in FIG. 5 the external side-forming shuttering 3 is set onto the platform 1, the latter remaining stationary.

In the position shown in FIG. 6 concrete mix is fed to the assembled pipe-forming mould through the device 8. As soon as the mould is filled with concrete mix the pipe end face is smoothed by means of the device 9, with the platform 1 rotating uniformly at a speed specified for a respective operation.

FIG. 7 illustrates the plant at the moment when the pipe moulding is terminated and the moulded pipe starts to be heated to impart a required initial strength to concrete mix, the platform 1 remaining stationary. In the position illustrated in FIG. 8, as soon as concrete gets hardened to a strength of 10 to 20 kgf/cm$^2$, the conduit-forming inserts 5 are alternatively lowered by means of the power actuator 6, with the platform 1 being consecutively turned through a preset angle.

Then the conduits and the pipe end face (FIG. 9) are poured with water, and the pipe continues to be heated until a preset final strength of concrete is achieved, the platform 1 remaining stationary.

Next the pipe (FIG. 10) is released from the external side-forming shuttering 3, the reinforcing wire 12 is held to the pipe and is then wound thereonto with the use of the mechanism 11 for feeding and tensioning said wire, which incorporates the device 13 for laying the reinforcing wire over the length of the pipe with a preset spacing. The wire is wound with the platform 1 rotating uniformly at a preset speed. The winding over, the reinforcing wire is fixed in position on the pipe, the platform 1 remaining stationary.

Then the reinforcement framework 14 for a second pipe layer is set onto the platform 1 (FIG. 11) along with the external side-forming shuttering 3 corresponding to the outside diameter of the second pipe layer, the platform 1 remaining stationary.

Figures 10, 11, 12, 13, 14, 15:
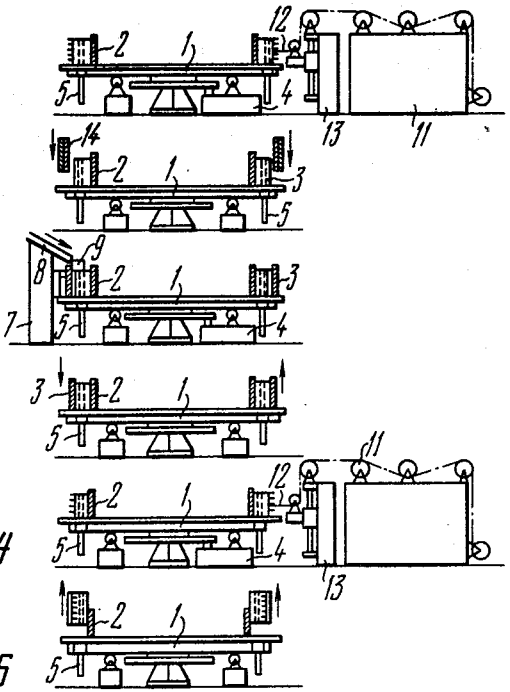
FIGS. 3 through 15 illustrate diagrammatically the operational sequence of a pipe production process, according to the invention.

In the position shown in FIG. 12 the space defined by the surface the previously moulded pipe and the external side-forming shuttering 3 is filled with concrete mix by means of the device 8, whereupon the pipe end face is smoothed flush with the end face of the previously moulded pipe with the help of the device 9, while the platform 1 is uniformly rotating at a preset speed.

Just after the second layer of the pipe has been moulded (FIG. 13) a second stage of heating the pipe begins until the concrete mass of the second layer acquires a preset strength, the platform 1 remaining stationary in this case.

Thereupon the pipe (FIG. 14) constituted by the two consecutively moulded concrete layers, is released from the external side-forming shuttering 3, the reinforcing wire 12 is held to the pipe and is then wound onto the rotating pipe in a way similar to that described above. In this case the platform 1 rotates uniformly at a preset speed. Upon terminating the winding the reinforcing wire 12 is locked in place on the pipe, the platform 1 remaining stationary.

Next a protective coating is applied to the moulded pipe above the reinforcing wire 12 wounded thereonto, using the device 10, with the platform 1 rotating uniformly at a preset speed. The protective coating having been placed, the pipe (FIG. 15) is transferred to the warehouse, where the protective coating hardens finally. Further on the entire pipe production cycle is repeated.

The afore-outlined sequence of the plant operation occurs when producing reinforced-concrete pipes from stressing cement, said pipe being intended to operate at high pressures (about 16 atm. gauge), when two-stage winding of the reinforcing wire is required (onto an intermediate and a finished pipe).

When producing pipes for operation at medium pressures (below 16 atm. gauge) one-stage winding of the reinforcing wire is carried out, and the operations illustrated in FIGS. 14 and 15 are dispensed with.

When making pipes for low pressures the production cycle is limited to the operations illustrated in FIGS. 3 through 9.

The plant is suitable for producing pipes designed to operate at pressures up to 16 atm. gauge by resorting to a single-stage winding of the reinforcing wire in a plurality of rows; this being the case the operations illustrated in FIGS. 3 through 9, 14 and 15 are to be performed.

The plant is also capable of producing pipes with some other patterns of reinforcing wire arrangement over the pipe outer surface.

In order to produce reinforced-concrete pipes with a bevelled end face adapted to form angular pipe joints at turns of the pipe-line being laid, it is expedient that the plant be provided with a set of inserts placed on the mould bottom, said inserts being made as flat rings having unparallel surfaces meeting at an angle corresponding to the angle of turn of the pipeline being laid.

One of the embodiments of the herein-proposed plant makes provision for utilization of the reinforcing-wire feeding and tensioning mechanism for alternately servicing a plurality of such plants. In this case the device for laying the reinforcing wire over the pipe length is made swivelling round a vertical axis.

The herein-proposed plant is suitable for producing pipes from self-stressed reinforced concrete featuring increased water-proofness as compared to pipes made from conventional reinforced concrete. In this case the external mould shuttering may be used as a catching device due to a pressure exerted by the self-stressed concrete upon the external shuttering, said pressure arising by virtue of the energy of concrete expansion. Estimation has proved that, with pipe diameter from 4 to 8 m, the energy of concrete expansion is high enough to take up the weight of the moulded pipe.

As it is evident from the above-discussed disclosure the herein-proposed plant for producing reinforced-concrete pipes is free from the effect of dynamic loads resulting from the imposition of the weight of a heavy workpiece which is the case during operation of the known pipe production equipment.

The present invention can find most utility when applied for laying sectional trunk pipelines of diverse applications, as a component of the equipment of reinforced-concrete factories supplying structural parts for pipeline construction.

What is claimed is:

1. Apparatus for producing reinforced concrete pipes particularly those of a large diameter comprising, a horizontal platform, means pivotally mounting the platform for rotation about an axis means for selectively rotating the platform about said axis, said platform having an upper surface for receiving an assembly of a mold thereon having an annular mold cavity with an open upper end for filling and defined by a core member and a removable mold form circumferentially of said mold core, means for automatically inserting elongated inserts axially into said mold cavity disposed spaced in a circumferential direction axially parallel with the axis of the mold for forming through axial openings in the wall of a pipe molded in said mold and removal thereof before concrete is fully set in said mold cavity, means for filling said mold cavity with concrete through said open upper end, means to smoothen the concrete at said open upper end during rotation of said platform thereby to smoothen the corresponding end of a pipe molded in said mold and means operative during rotation of said platform to wind reinforcing wire circumferentially about the concrete pipe with the core in place after removal of the mold form and the wire extending axially of the pipe.

2. Apparatus for producing reinforced concrete pipes particularly those of a large diameter according to claim 1, in which said means to insert the elongated inserts comprises means to insert the inserts from underneath the platform.

3. Apparatus for producing reinforced concrete pipe particularly those of a large diameter according to claim 1, including means to apply a coating to said pipe during rotation of said platform.

* * * * *